US005324440A

United States Patent [19]

Delfort et al.

[11] Patent Number: 5,324,440

[45] Date of Patent: Jun. 28, 1994

[54] SURBASED COLLOIDAL PRODUCT CONTAINING ORGANIC SULFUR AND THEIR USE AS DETERGENT ADDITIVES HAVING AN ANTIWEAR AND EXTREME-PRESSURE EFFECT IN LUBRICATING OILS

[75] Inventors: Bruno Delfort, Paris; Maurice Born, Nanterre; Jacques Lallement, Aubervilliers; Guy Parc, Rueil Malmaison, all of France

[73] Assignee: Institut Francais du Petrole, Rueil Malmaison, France

[21] Appl. No.: 37,131

[22] Filed: Mar. 25, 1993

[30] Foreign Application Priority Data

Mar. 26, 1992 [FR] France ..... 92 03789

[51] Int. Cl.[5] ..... C10M 135/00

[52] U.S. Cl. ..... 252/18; 252/25; 252/33.4; 252/49.6; 252/33.2

[58] Field of Search ..... 252/18, 25, 33.4, 49.6, 252/33.2

[56] References Cited

U.S. PATENT DOCUMENTS

| | | | |
|---|---|---|---|
| 2,417,429 | 3/1947 | McLennan | 252/36 |
| 2,491,066 | 12/1949 | Wasson et al. | 148/6.24 |
| 3,714,042 | 1/1973 | Greenough | 252/33.4 |
| 4,328,111 | 5/1982 | Watson et al. | 252/33.4 |
| 4,617,135 | 10/1986 | Muir | 252/33.4 |
| 5,242,608 | 9/1993 | Steckel | 252/33.4 |

*Primary Examiner*—Jacqueline V. Howard
*Attorney, Agent, or Firm*—Millen, White, Zelano & Branigan

[57] ABSTRACT

A description is given of colloidal sulphur products, their preparation and their use as additives in lubricating oils. These products result from the reaction on a superbasic detergent additive, optionally modified by reaction with a boron derivative, of a "small size" sulphur carboxylic acid complying with the general formula $$X—R^1—Sx—R^3—Sy—R^2—COOH$$

in which $R^1$ and $R^2$ each represent a divalent hydrocarbon radical, $R^3$ represents a single bond or a divalent hydrocarbon radical, X represents a hydrogen atom or a carboxylic group and x and y are in each case a mean value from 1 to 4 when $R^3$ is a hydrocarbon radical and the sum x plus y is a mean value from 1 to 4 when $R^3$ represents a single bond. Apart from their detergent properties, these products have high extreme pressure and antiwear properties, as well as an improved thermal stability and a satisfactory corrosivity with respect to copper. They are particularly suitable for use in engine oils, gear oils, hydraulic fluids and metal working oils.

12 Claims, No Drawings

SURBASED COLLOIDAL PRODUCT CONTAINING ORGANIC SULFUR AND THEIR USE AS DETERGENT ADDITIVES HAVING AN ANTIWEAR AND EXTREME-PRESSURE EFFECT IN LUBRICATING OILS

BACKGROUND OF THE INVENTION

The invention relates to novel sulphur products compatible with lubricating oils. It also relates to the preparation of these products and their use as additives having an extreme pressure and antiwear actions in mineral or synthetic, lubricating oils, e.g. in engine oils, gear oils, hydraulic fluids or metal working oils.

Superbasic detergent additives have been known for a long time. Certain of them and their preparation have e.g. been described in U.S. Pat. Nos. 2,865,956, 3,150,088, 3,537,996, 3,830,739, 3,865,737, 4,148,740, 3,953,519, 3,966,621 and 4,505,830 and French Patent 2,101,813. There are variants of the superbasification reaction using high performance carbonates based on alkoxides and $CO_2$, prior to the contacting with the alkali metal or alkaline earth salt of the acid compound and are more particularly described in U.S. Pat. Nos. 2,956,018, 3,932,289 and 4,104,180.

It is also known to modify superbasic detergent additives by incorporating boron derivatives, as is e.g. described in U.S. Pat. Nos. 3,929,650, 3,907,691, 4,965,003 and 4,965,004.

Finally, the modification of superbasic detergent additives by certain carboxylic acids, boric acids or phosphoric acids has also been described in U.S. Pat. No. 4,328,111.

SUMMARY OF THE INVENTION

It has now been discovered that it was possible to prepare colloidal products by reacting certain sulphur carboxylic acids with superbasic detergent additives, used as they are or previously modified by reaction with boron compounds.

The products proposed by the invention have high antiwear and extreme pressure properties, improved thermal stability and oxidation stability, as well as reduced corrosivity with respect to copper as compared with the additives conventionally used for achieving the same objectives.

The colloidal sulphur products according to the invention can in general terms be defined by the fact that they result from the reaction of at least one "small size" sulphur carboxylic acid, as defined hereinafter, with at least one colloidal superbasic detergent compound.

The starting superbasic detergents can be more particularly constituted by a surfactant, such as a sulphonate, phenate, salicylate or naphthenate of an alkali metal or alkaline earth element, which ensures a colloidal dispersion of the carbonate and/or hydroxide of an alkali metal or alkaline earth element. Examples of superbasic detergents are sulphonates, phenates, salicylates or naphthenates of calcium, barium or magnesium having a total base number (TBN) up to approximately 600.

In the preparation of the colloidal sulphur products according to the invention, said superbasic detergents can be used as they are or can be treated beforehand by at least one compound containing boron, such as boric acid, boric anhydride, ammonium, sodium and similar borates. In the latter case, the boron:metal atomic ratio in the modified superbasic detergent can e.g. be up to approximately 1:1.

The "small size" sulphur carboxylic acids used in the preparation of the colloidal products according to the invention can more particularly comply with the general formula:

$$X—R^1—Sx—R^3—Sy—R^2—COOH \quad (I)$$

in which $R^1$ and $R^2$ each represent a divalent hydrocarbon radical, e.g. an alkylene radical with 1 to 6 carbon atoms or a phenylidene radical, $R^3$ represents a single bond or a divalent hydrocarbon radical, e.g. an alkylene radical with 1 to 4 carbon atoms, X represents a hydrogen atom or a carboxylic group and x and y in each case have a mean value of 1 to 4 when $R^3$ is a divalent hydrocarbon radical and the sum $(x+y)$ has a mean value of 1 to 4 when $R^3$ represents a single bond.

More particularly, when $R^3$ is a single bond and X represents COOH, the sulphur carboxylic acids are of form $$HOOC—R^1—S_{(x+y)}—R^2—COOH$$

and it is e.g. possible to give as examples thio, trithio and tetrathio-diglycolic, dipropionic, dibutyric and 2,2'-dithio dibenzoic acids.

When $R^3$ is a divalent hydrocarbon radical and X is a carboxylic group, the acids are of form $$HOCO—R^1—Sx—R^3—Sy—R^2—COOH$$

and it is possible to give as examples methylene and ethylene-bis (thio, dithio and trithio-acetic) and methylene and ethylene-bis (thio, dithio and trithio-propionic) acids.

Finally, when $R^3$ is a single bond and X a hydrogen atom, the acids are in form $$HR^1—S_{(x+y)}—R^2—COOH$$

and it is easily possible to give as examples ethyl thio, dithio and trithio-acetic, propionic and butyric acids.

These acids can be obtained by various synthesis methods, namely: by condensation of the appropriate chlorine carboxylic acid with alkali metal or alkaline earth metal sulphide or polysulphide, or with a mono or di-mercaptan or with a mercaptate; by careful oxidation of a mercaptan, optionally in the presence of sulphur; by the action of sulphur mono or di-chloride on a mercaptan or its sodium salt; or by the reaction of thionyl chloride on a mercaptan, followed by the reduction of the sulphoxide obtained into sulphide.

The synthesis of the colloidal sulphur products according to the invention can more particularly be carried out under the conditions indicated hereinafter. The sulphur carboxylic acid used can be introduced in solution in water or in an organic solvent such as e.g. tetrahydrofuran (THF), toluene or xylene. It is added to the superbasic detergent compound, which is itself in solution in an organic solvent, such as e.g. toluene, xylene, hexane or tetrahydrofuran. The sulphur carboxylic acid proportion is generally such that it can neutralize the superbasic detergent to a level which can be up to approximately 50% of its total base number (TBN) and is usually between 10 and 30% thereof.

The action of a sulphur carboxylic acid on a superbasic detergent compound leads to a sulphur carboxylate of an alkali metal or alkaline earth element. When the carboxylic acid is of "small size", in the sense used in the invention, the isolated salt obtained is generally totally insoluble in oils and hydrocarbons. Thus, surprisingly, the action of "small size" sulphur carboxylic acids on superbasic colloidal compounds leads to time-stable, clear, homogeneous products without precipitation.

These unexpected characteristics gives rise to the idea that the sulphur carboxylates, which are intrinsically insoluble in oils, reoccur in the synthesis process of the products according to the invention within the micelles of the colloidal dispersion, in the same way as the carbonate and/or hydroxide of the alkali metal or alkaline earth element. Dialysis tests have confirmed this hypothesis.

The colloidal sulphur products according to the invention are usable as detergent additives having antiwear and extreme pressure actions of high level for mineral or synthetic, lubricating oils. These combined effects, linked with an improved thermal stability and an appropriate corrosivity with respect to copper, make them particularly interesting when used in engine oils, gear oils, hydraulic fluids and metal working oils. In these applications, use is generally made of 1 to 30 and preferably 5 to 20% by weight of products in the oil in question.

In these applications, the antiwear and extreme pressure performance level of the lubricating compositions containing the products according to the invention is comparable to that expected with conventional liposoluble sulphur additives. However, their corrosivity with respect to copper is reduced and their thermal stability and oxidation resistance are improved.

EXAMPLES

The following examples illustrate the invention, but in no way limit the scope thereof.

First of all a description will be given of colloidal superbasic substrates used in the preparation of the products according to the invention (substrates I to VII).

Substrate (I) is a superbasic calcium sulphonate prepared according to the following operating procedure. Into a 1 liter reactor equipped with a condenser, a thermometer, a stirrer and a carbon dioxide bubbling device are introduced 210 g of alkyl aryl sulphonic acid of molar mass 697 to 69% of active material, 783 ml of toluene, 123 g of 130 Neutral solvent oil, 260 ml of methanol and 115.15 g of calcium hydroxide. The mixture is stirred for 15 minutes at ambient temperature, followed by the introduction of 49.5 g of carbon dioxide in 60 minutes at a temperature not exceeding 37° C. Following decanting, drawing off and filtration takes place of the lower phase.

After evaporating the solvent, recovery takes place of 410 g of product (I), which is a viscous liquid, clear brown, soluble in mineral and synthetic oils, alkaline value 337 mg KOH/g; calcium: 12.09%; active material: 58%; oil: 42%.

Substrates (II) to (VII) are the following commercial superbasic colloidal additives:

calcium sulphonate (II): alkaline value 300 mg KOH/g; calcium: 11.90%; sulphur: 1.85%, active material: 54.30%; oil: 45.70%;

calcium sulphonate (III): alkaline value 410 mg KOH/g; calcium: 15.60%; sulphur: 0.95%, active material: 54.00%; oil: 46.00%;

calcium sulphonate (IV): alkaline value 502 mg KOH/g; calcium: 18.7%; sulphur: 1.20%, active material: 59.50%; oil: 40.50%;

magnesium sulphonate (V): alkaline value: 400 mg KOH/g; magnesium: 9.40%; sulphur: 1.80%, active material: 59.00%; oil: 41.00%;

calcium phenate (VI): alkaline value: 257 mg KOH/g; calcium: 9.25%; sulphur: 3.35%;

calcium salicylate (VII): alkaline value: 280 mg KOH; calcium: 10.00%.

The "alkaline values" indicated can also be designated by total base number or TBN. The percentages are by weight.

COMPARATIVE EXAMPLES 1 TO 4

For comparison purposes non-colloidal magnesium and calcium sulphur carboxylates were synthesized and their solubility evaluated. To a magnesium or calcium carbonate dispersion in water was added a sulphur carboxylic acid as it was and in accordance with the quantities defined hereinafter. In each case the reaction was performed at ambient temperature, whilst stirring up to the end of the giving off of carbon dioxide. After filtering the excess carbonate, the water was evaporated and a white solid was collected and its characteristics are given in the following table I.

TABLE I

| Comparative Example | Carboxylic Acid | Carbonate | Carboxylate obtained |
|---|---|---|---|
| 1 | dithiodiglycolic 9.10 g | $CaCO_3$ 6.0 g | Ca: 18.65 wt. % |
| 2 | thiodipropionic 8.90 g | $CaCO_3$ 6.0 g | Ca: 18.35 wt. % |
| 3 | thiodiglycolic 7.50 g | $CaCO_3$ 6.0g | Ca: 21.6 wt. % |
| 4 | dithiodiglycolic 9.10 g | $MgCO_3$ 5.0 g | Mg: 11.82 wt. % |

These products are completely insoluble in hydrocarbons and oils, no matter what temperature is used.

The following examples 1 to 28 illustrate the preparation of products according to the invention.

EXAMPLE 1

Into a 1 liter reactor equipped with a stirrer, a Dean and Stark separator, and a thermometer are introduced 100 g of superbasic calcium sulphonate (I) and then 250 ml of xylene. The medium is heated up to 70° C. and in 30 minutes and accompanied by stirring introduction takes place of a solution of 5.47 g of dithiodiglycolic acid in 40 ml of water. Following the end of addition, the mixture is allowed to completely react and in this way 10% of the alkaline value will be neutralized. The temperature is then progressively raised to distil the water, followed by the filtration of the medium and the evaporation in vacuo of the xylene. 101 g of a viscous, brown, clear liquid, which is soluble in oils are obtained, having the characteristics given in Table II.

EXAMPLE 2

The procedure of Example 1 is used, but dithioglycolic acid is introduced into 40 ml of tetrahydrofuran (THF) instead of 40 ml of water. A product is obtained, whose characteristics are identical to those of the product of Example 1.

EXAMPLES 3 to 16

The procedure of Example 2 is used, the nature of the superbasic calcium sulphonate, as well as the nature and quantity of the sulphur acid introduced being varied. The characteristics of the products obtained are given in Table II.

EXAMPLE 17

The procedure of Example 2 is used, the superbasic calcium sulphonate (I) being replaced by superbasic magnesium sulphonate (V), on which is reacted the dithioglycolic acid at 10% of the alkaline value.

EXAMPLE 18

EXAMPLE 19

The procedure of Example 18 is used, but a superbasic calcium salicylate (VII) is used as the superbasic substrate.

The characteristics of the products obtained according to Examples 2 to 19 are given in Table II.

The absence of a band at 1690 $cm^{-1}$ in infrared spectroscopy confirms the total conversion of the carboxylic acid into calcium or magnesium carboxylate. This is proved by all the examples. The products obtained are characterized by their calcium, magnesium or sulphur content, their oil and active material composition determined by dialysis through a latex diaphragm, as well as the sulphur content of these two fractions.

TABLE II

| Example | Starting products | | | | Characteristics of the products prepared | | | | | |
|---|---|---|---|---|---|---|---|---|---|---|
| | Superbasic substrate | | Sulphur acid | | Crude product | | Concentrate | | Dialyzate | |
| No. | Reference | TBN | Nature | TBN % | wt. % Ca | wt. % S | % | wt. % S | % | wt. % S |
| 1-2 | CaSu (I) | 337 | $S_2(CH_2COOH)_2$ | 10 | 12.0–12.2 | 3.40–3.30 | | 5.30 | | 0.30* |
| 3 | CaSu (II) | 300 | $S(CH_2COOH)_2$ | 20 | 11.1 | 3.40 | 56.0 | 5.50 | 44.0 | 0.50 |
| 4 | " | " | " | 30 | | 4.10 | 58.0 | 5.95 | 42.0 | 0.45 |
| 5 | " | " | " | 40 | | 5.00 | | 5.00 | | 0.45 |
| 6 | " | " | $S_2(CH_2COOH)_2$ | 10 | 11.6 | 3.10 | 60.5 | 4.40 | 39.5 | 0.45 |
| 7 | " | " | " | 20 | 11.0 | | 57.0 | | 43.0 | |
| 8 | CaSu (III) | 410 | $S(CH_2COOH)_2$ | 10 | | 1.80 | 56.6 | 3.50 | 43.4 | 0.30 |
| 9 | " | " | " | 20 | 13.9 | 3.50 | 56.7 | 5.50 | 43.3 | 0.30 |
| 10 | " | " | $S(CH_2CH_2COOH)_2$ | 10 | | 1.90 | 59.4 | 3.10 | 40.6 | 0.10 |
| 11 | " | " | $S(CH_2CH_2COOH)_2$ | 20 | | 3.25 | 63.0 | 5.40 | 37.0 | 0.40 |
| 12 | " | " | $S_2(CH_2OOH)_2$ | 10 | 14.5 | 3.20 | 57.5 | 4.60 | 42.5 | 0.25 |
| 13 | " | " | " | 20 | 13.8 | 5.60 | | 7.50 | | 0.40 |
| 14 | " | " | $CH_3CH_2SCH_2COOH$ | 20 | | 3.80 | | 5.60 | | 0.50 |
| 15 | CaSu (IV) | 502 | $S(CH_2COOH)_2$ | 20 | 16.1 | 3.90 | 56.8 | 4.40 | 42.3 | 0.50 |
| 16 | " | " | $S_2(CH_2COOH)_2$ | 10 | 17.2 | 3.60 | 62.0 | 4.20 | 38.0 | 0.50 |
| 17 | MgSu (V) | 400 | " | 10 | 8.6 (Mg) | 3.60 | | 5.70 | | 0.30 |
| 18 | CaPh (VI) | 257 | " | 10 | 8.25 | 3.90 | | 4.50 | | 0.60 |
| 19 | CaSa (VII) | 280 | " | 10 | 8.40 | 1.10 | | 1.90 | | 0.20 |

*sulphur content of the 130 Neutral oil used for the synthesis of superbasic sulphonate: 0.3%

TABLE III

| Example | Superbasic substrate | | Boron/calcium | Sulphur carboxylic acid | | Characteristics of products prepared | | | | | |
|---|---|---|---|---|---|---|---|---|---|---|---|
| | | | | | | Crude product | | Concentrate | | Dialyzate | |
| No. | Ref. | TBN | atomic ratio | Nature | % TBN | wt. % Ca | wt. % S | % | wt. % S | % | wt. % S |
| 21 | CaSu (I) | 337 | 0.4 | $S_2(CH_2COOH)_2$ | 10 | 11.6 | 3.40 | | 5.30 | | 0.40 |
| 22 | CaSu (II) | 300 | " | " | " | 11.3 | 3.10 | | 4.30 | | 0.40 |
| 23 | " | " | 0.8 | " | " | 11.5 | 3.10 | | | | |
| 24 | CaSu (III) | 410 | 0.4 | " | " | 14.3 | 3.10 | 58.0 | 5.00 | 42.0 | 0.15 |
| 25 | " | " | 0.8 | " | " | 14.3 | 2.90 | 59.0 | 4.40 | 41.0 | 0.30 |
| 26 | " | " | 0.4 | " | 15 | 13.8 | 3.90 | | 5.50 | | 0.40 |
| 27 | CaSu (IV) | 502 | 0.4 | " | 10 | 16.2 | 3.30 | | 4.60 | | 0.25 |
| 28 | | " | 0.8 | " | " | 15.9 | 2.90 | | 4.10 | | 0.40 |

The procedure of Example 17 is used, but superbasic calcium phenate (VI) constitutes the superbasic substrate.

TABLE IV

| Additive | | Evaluated Oil | | | Antiwear and extreme pressure characteristics on 4-ball machine | | | | |
|---|---|---|---|---|---|---|---|---|---|
| | | | | | | | Dia. of impression (mm) after 1h under a load of | | |
| Superbasic substrate | Modified according to example | wt. % additive/130 N oil | wt. % Ca/130 N oil | wt. % S/* 130 N oil | Load/wear | Welding load | 40 KgF 392.4N | 60 KgF 588.6N | 80 KgF 784.8N |
| CaSu (I) | — | 11.6 | 1.40 | | 415.9 | 2452.5 | 0.36 | 0.45 | |
| " | 1 | 11.7 | " | 0.397 | 458.1 | 3090.2 | 0.35 | 0.50 | 0.96 |
| " | 2 | 11.7 | " | 0.386 | 456.1 | 3090.2 | 0.35 | 0.48 | 0.93 |
| " | 21 | 12.1 | " | 0.409 | 467.0 | 3090.2 | 0.36 | 0.42 | 0.47 |
| CaSu (II) | — | 11.7 | " | 0.22 | 347.2 | 2452.5 | 0.32 | 0.45 | 0.57 |
| " | 3 | 12.1 | " | 0.41 | 432.6 | 3090.2 | 0.33 | 0.40 | 0.55 |
| " | 4 | 13.2 | " | 0.54 | 355.1 | 3090.2 | | | |

TABLE IV-continued

| Additive | | Evaluated Oil | | | Antiwear and extreme pressure characteristics on 4-ball machine | | | | |
|---|---|---|---|---|---|---|---|---|---|
| | | | | | | | Dia. of impression (mm) after 1h under a load of | | |
| Superbasic substrate | Modified according to example | wt. % additive/130 N oil | wt. % Ca/130 N oil | wt. % S/* 130 N oil | Load/wear | Welding load | 40 KgF 392.4N | 60 KgF 588.6N | 80 KgF 784.8N |
| " | 6 | 12.1 | " | 0.349 | 444.4 | 2452.5 | 0.35 | 0.39 | 0.44 |
| " | 7 | 12.7 | " | | 470.9 | 3090.2 | | | |
| " | 22 | 12.4 | " | 0.385 | 468.9 | 2452.5 | 0.36 | 0.43 | 0.47 |
| " | 23 | 12.2 | " | 0.378 | 441.5 | 2452.5 | 0.38 | 0.69 | |
| CaSu (III) | — | 8.9 | 1.40 | 0.08 | 270.8 | 2452.5 | 0.32 | 0.38 | 0.43 |
| " | 12 | 9.6 | " | 0.308 | 447.3 | 2452.5 | 0.37 | 0.43 | 0.51 |
| " | 13 | 10.2 | " | 0.57 | 492.5 | 3090.2 | 0.48 | 0.66 | 0.88 |
| " | 24 | 9.8 | " | 0.393 | 564.1 | 3090.2 | 0.33 | 0.44 | 0.50 |
| " | 25 | 9.8 | " | 0.284 | 519.9 | 2452.5 | 0.36 | 0.44 | 0.73 |
| " | 26 | 10.2 | " | 0.397 | 404.2 | 3090.2 | 0.37 | 0.43 | 0.64 |
| " | 20 | 9.4 | " | 0.103 | 340.4 | 2354.4 | 0.33 | 0.37 | 0.41 |
| CaSu (IV) | — | 7.5 | " | 0.09 | 438.5 | 2452.5 | 0.32 | 0.36 | 0.45 |
| " | 15 | 8.7 | " | 0.34 | | 3090.2 | | | |
| " | 16 | 8.2 | " | 0.293 | 523.9 | 2452.5 | 0.35 | 0.42 | 0.48 |
| " | 27 | 8.6 | " | 0.285 | 470.9 | 2550.6 | 0.35 | 0.43 | |
| " | 28 | 8.8 | " | 0.255 | 521.9 | 2452.5 | 0.38 | 0.44 | 0.69 |
| MgSu (V) | — | 9.4 | 1.40 (Mg) | | 234.5 | 1569.6 | 0.62 | 1.50 | 1.87 |
| | 17 | 11.2 | " | 0.379 | 319.8 | 2452.5 | 0.38 | 1.58 | 1.88 |
| Commercial liposoluble sulphur additive | | 1.16 | 0 | 0.379 | 319.8 | 2452.5 | 0.38 | 1.58 | 1.88 |

*sulphur supplied by additive

TABLE V

| Characteristics considered | Method | Unit | Additive Ex. 2 oil | | Additive ex. 21 oil | | Additive Ex. 22 oil | | Comparative Ex. liposoluble add. oil | |
|---|---|---|---|---|---|---|---|---|---|---|
| | | | new | oxidized | new | oxidized | new | oxidized | new | oxidized |
| visc. 40° C. | NF T60 100 | $mm^2/s$ | 31.8 | 33.8 | 31.33 | 32.08 | 31.08 | 32.96 | 28.64 | 61.8 |
| visc. 100° C. | " | " | 5.46 | 5.68 | 5.38 | 5.52 | 5.53 | 6.30 | 5.04 | 8.17 |
| TAN | ASTM method | mg KOH/g | 4.24 | 4.93 | 5.14 | 5.16 | 4.26 | 4.64 | 2.79 | 7.34 |
| visc. variation 40° C. | GFC T021 | % | +5.22 | | +2.40 | | +6.05 | | +115.8 | |
| visc. variation 100° C. | A 90 | % | +3.84 | | +2.60 | | +13.9 | | +62.1 | |
| TAN variation | | % | +16.3 | | +0.4 | | +8.9 | | +163 | |
| insol suspension | GFC T022 | % | 0 | | 0 | | 0 | | 0 | |
| insol deposits | A90 | % | 0 | | 0 | | 0 | | 0 | |

The results indicate that the sulphur contained in the additives does not dialyse through the diaphragm, which means that it is incorporated into the micelles. The observations made on the basis of the products of comparative examples 1 to 4 lead to the same conclusion. Thus, the calcium and magnesium carboxylates of the considered sulphur acids are insoluble in oil, the obtaining of homogeneous products here confirming the micellization of these carboxylates.

EXAMPLE 20 (COMPARATIVE)

The operating procedure of Example 7 is used, the sulphur acid being replaced by succinic acid at a rate such that 10% of the alkaline value of the superbasic sulphonate is neutralized.

EXAMPLE 21

Into a 1 liter reactor equipped with a condenser, a thermometer and a stirrer are introduced 100 g of superbasic calcium sulphonate (I) and 250 ml of xylene. To this mixture are added in 1 hour 7.47 g of boric acid dissolved in 50 ml of methanol at the boiling point of the methanol. A Dean and Stark separator is then fitted, followed by the distillation of the methanol and then the reaction water formed. At this stage of the operation at 70° C., 6.65 g of dithioglycolic acid dissolved in 40 ml of THF are introduced, in accordance with Example 2. After filtration and elimination of the solvent, 98 g of an oil-soluble, clear, homogeneous, viscous liquid are collected.

EXAMPLES 22 TO 28

The operating procedure of example 21 is used, while varying the nature of the superbasic calcium sulphonate and the quantities of boric and dithiodiglycolic acids introduced. The characteristics of the products obtained according to examples 21 to 28 are given in Table III. The absence of a band at 1690 $cm^{-1}$ in infrared spectroscopy for each of the products confirms the total conversion of the acid into carboxylate. The examination of the dialysis results indicates that the sulphur contained in the additive is incorporated into the micelle.

EXAMPLE 29

Evaluation of the antiwear and extreme pressure properties —4 ball tests.

The products according to the invention are evaluated for their antiwear and extreme pressure properties in a lubricating oil. The latter is constituted by a 130 Neutral mineral oil. The mixtures are formed at a constant calcium level of 140% by weight in the oil.

The antiwear and extreme pressure performance characteristics are evaluated on a 4 ball machine according to standard ASTM D 2783. The results are given in Table IV. For comparison purposes, the results are given for the unmodified substrates (I) to (V). These results show that the products according to the invention have good antiwear and extreme pressure properties.

The antiwear and extreme pressure performance characteristics of a composition containing a superbasic additive are improved when the latter has been modified by a sulphur carboxylic acid according to the invention. The modification by a non-sulphur carboxylic acid leads to no supplementary improvement in the antiwear and extreme pressure properties (cf. the result corresponding to the product of example 20). The antiwear and extreme pressure characteristics of compositions containing the products according to the invention are comparable to those obtained with a conventional liposoluble sulphur additive.

EXAMPLE 30

The oxidation resistance of the oils containing the products according to the invention was evaluated by the GFC TO21 A90 method. The principle consists of oxidizing an oil sample, in this case at 150° C., while ensuring air bubbling with a constant flow rate of 10 liters/hour for 192 hours. Viscosity total acid number and insoluble content measurements are performed on the samples before and after oxidation. These tests were carried out on compositions of products according to the invention at a concentration in Neutral oil 130 such that the calcium level is equal to 140% by weight.

A comparative test was carried out with a non-colloidal, liposoluble, commercial sulphur product with an identical sulphur level. This test was carried out in the presence of super-basic calcium sulphonate (III) at a level such that calcium is 1.40% by weight.

Examination of the results given in Table V reveals a very good behavior of the compositions containing the products according to the invention, namely the absence of deposits, limited viscosity variations at 40° and 100° C. and also small acid number variations.

EXAMPLE 31

Copper corrosion tests were carried out for 3 hours at 150° C. according to standard NF M 070-15 (equivalent to standard ASTM D 130-75). These tests were carried out on compositions of products according to the invention in Neutral 130 oil and at a concentration such that the calcium level is 1.40% by weight.

A comparative test on a non-colloidal, liposoluble, sulphur additive of a commercial nature was carried out. It was performed with a sulphur level comparable to those for the products according to the invention and in the presence of superbasic calcium sulphonate (III) in such a way that the calcium is 1.40%.

The results are given in the following table:

| Additive reference | wt. % S/oil | wt. % Ca/oil | Cu corrosion rating |
|---|---|---|---|
| Ex. 2 | 0.386 | 1.40 | 3b |
| Ex. 12 | 0.308 | " | 3b |
| Ex. 21 | 0.409 | " | 2c |
| Ex. 22 | 0.385 | " | 2a |
| comparative liposoluble sulphur | 0.371 | " | 4b |

Examination of the results reveals that for constant sulphur and calcium levels, the compositions obtained from products according to the invention, i.e. those for which the sulphur additive is colloidal, are much less corrosive with respect to copper than when the extreme pressure/antiwear sulphur additive is a liposoluble additive.

We claim:

1. A sulphur colloidal product, obtained by a process comprising reacting a superbasic detergent compound with a sulphur carboxylic acid of the formula:

$$X—R^1—S_x—R^3—S_y—R^2—COOH \quad (I)$$

in which $R^1$ and $R^2$ are each independently $C_{1-6}$-alkylene or phenylidene, $R^3$ is a single bond or a $C_{1-4}$-alkylene, X is a hydrogen atom or carboxylic group and x and y each have a mean value of 1 to 4 when $R^3$ is alkylene and the sum (x+y) has a mean value of 1 to 4 when $R^3$ is a single bond.

2. A product according to claim 1, wherein in formula (I) of said sulphur carboxylic acid, $R^3$ is a single bond, X is a carboxylic group and the sum (x+y) has a mean value of 1 to 4.

3. A product according to claim 2, wherein the sulphur carboxylic acid is a thio-, dithio-, trithio-, tetrathio-diglycolic, dipropionic, or dibutyric acid, or 2,2'-dithiodibenzoic acid.

4. A product according to claim 1, wherein in formula (I) of said sulphur carboxylic acid, $R^3$ is an alkylene radical with 1 to 4 carbon atoms, X is a carboxylic group, and x and y each independently have a mean value of 1 to 4.

5. A product according to claim 1, wherein said sulphur carboxylic acid is methylene- or ethylene-bis (thio, dithio or trithio-acetic) acid or methylene- or ethylene-bis (thio, dithio or trithio-propionic) acid.

6. A product according to claim 1, wherein in formula (I) of said sulphur carboxylic acid, $R^3$ is a single bond, X is a hydrogen atom, and the sum (x+y) has a mean value of 1 to 4.

7. A product according to claim 1, wherein said sulphur carboxylic acid is ethyl thio, dithio or trithio acetic, propionic or butyric acid.

8. A product according to claim 1, wherein said superbasic detergent compound is a sulphonate, phenate, salicylate or naphthenate of an alkali metal or alkaline earth element superbased by a carbonate or hydroxide of an alkali metal or alkaline earth metal element.

9. A product according to claim 1, wherein said superbasic detergent compound is a sulphonate, phenate, salicylate or naphthenate of a superbasic nature having a total base number up to approximately 600.

10. A product according to claim 1, wherein said superbasic detergent compound is previously modified by reaction with at least one boron-containing compound.

11. A product according to claim 10, wherein the compound containing boron is used in a proportion with respect to said superbasic detergent compound corresponding to a boron:metal atomic ratio of at the most 1:1.

12. A product according to claim 1 wherein said sulphur carboxylic acid is reacted while in solution in water or in an organic solvent and said superbasic detergent compound is reacted while in solution in a hydrocarbon solvent.

* * * * *